United States Patent [19]

Behnke et al.

[11] Patent Number: 4,736,179

[45] Date of Patent: Apr. 5, 1988

[54] IGNITION COIL FOR INTERNAL COMBUSTION ENGINES

[75] Inventors: Horst Behnke, Esslingen; Robert Tschuk, Aschaffenburg, both of Fed. Rep. of Germany

[73] Assignees: Daimler-Benz AG; May & Christe GmbH Transformatorenwerke, both of Fed. Rep. of Germany

[21] Appl. No.: 829,332

[22] Filed: Feb. 14, 1986

[30] Foreign Application Priority Data

Feb. 15, 1985 [DE] Fed. Rep. of Germany ..... 3505367

[51] Int. Cl.[4] ..... H01F 27/08; H01F 15/02; H01F 27/26

[52] U.S. Cl. ..... 336/61; 336/65; 336/67; 336/96; 336/210

[58] Field of Search ..... 336/61, 65, 67, 68, 336/210, 98, 96

[56] References Cited

U.S. PATENT DOCUMENTS

| | | | |
|---|---|---|---|
| 1,524,591 | 1/1925 | Starr | 336/65 |
| 1,545,429 | 7/1925 | Hunt . | |
| 1,579,955 | 4/1926 | Schermerhorn et al. | 336/210 X |
| 1,632,101 | 6/1927 | Thordarson | 336/210 X |
| 1,799,790 | 4/1931 | Helgason et al. | 336/98 |
| 1,963,016 | 6/1934 | Ehrlich . | |
| 1,974,588 | 9/1934 | Snell | 336/210 X |
| 2,418,531 | 4/1947 | Tognola . | |
| 2,494,350 | 1/1950 | Mittenmaier | 336/65 X |
| 2,529,653 | 11/1950 | Epstein | 336/210 X |
| 2,770,785 | 11/1956 | Haagens et al. | 336/61 |
| 2,903,661 | 12/1956 | Goffstein | 336/65 |
| 3,110,874 | 11/1963 | Dowdle et al. | 336/65 X |
| 3,168,777 | 2/1965 | Ridder et al. | 336/61 X |
| 3,179,908 | 8/1980 | Peabody | 336/61 |
| 4,438,421 | 3/1984 | Leach, Jr. | 336/65 |
| 4,494,101 | 1/1985 | Buchschmid et al. | 336/210 |

FOREIGN PATENT DOCUMENTS

| | | | |
|---|---|---|---|
| 208879 | 3/1956 | Australia | 336/210 |
| 0072266 | 2/1983 | European Pat. Off. . | |
| 0102261 | 6/1983 | European Pat. Off. . | |
| 1098664 | of 1955 | France . | |
| 51123384 | 4/1981 | Japan . | |
| 610241 | 10/1948 | United Kingdom . | |
| 814861 | 6/1959 | United Kingdom . | |
| 1538408 | 1/1979 | United Kingdom . | |
| 426249 | 10/1974 | U.S.S.R. | 336/61 |

*Primary Examiner*—Thomas J. Kozma
*Attorney, Agent, or Firm*—Sughrue, Mion, Zinn, Macpeak, and Seas

[57] ABSTRACT

An ignition coil (1) for internal combustion engines comprises a magnetic core (4) of the core- of sleeve type, around the main core of which the primary and secondary winding being insulatingly enveloped with a cast material is arranged, the end regions of the main core being connected with each other via a magnetic path located outside the two windings, and having mounting members attached to the magnetic core (4) for mounting the ignition coil (1) to an automobile body. In order to bring the heating of the windings to an equal level and to reduce the heating of the windings, the mounting members are formed of a mounting plate (8) with mounting surface (9) and of at least one frame member (10, 11) integrally formed with the mounting plate (8) which envelopes the magnetic core (4) in a form-locking manner. The frame members (10, 11) can be expediently placed for mounting angularly on the ignition coil (1) and are pivotable in abutment with the surface of the magnetic core (4).

7 Claims, 6 Drawing Sheets

Figure 1:
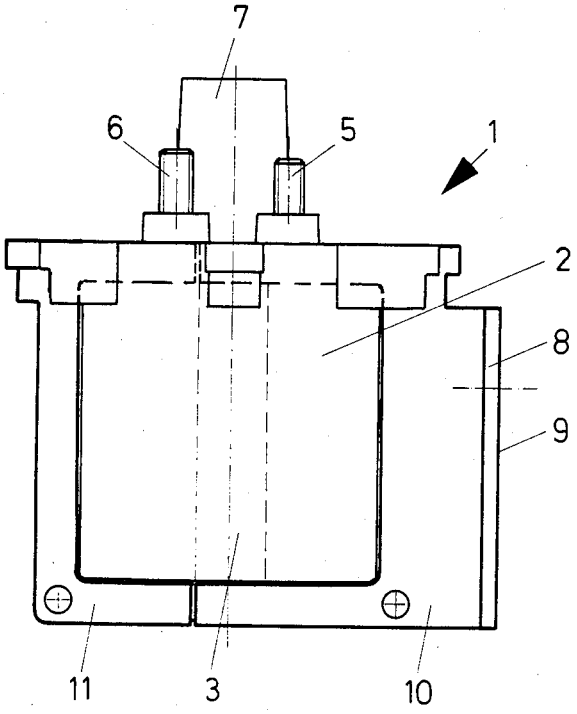

A --- Prior Art
B —— according to Invention

A1, B1 Primary Winding
A2, B2 Secondary Winding
A3, B3 Surface of Cast Material Body
A4, B4 Mounting Surface

IGNITION COIL FOR INTERNAL COMBUSTION ENGINES

The invention relates to an ignition coil for internal combustion engines with magnetic core of the core or sleeve type, around the main core of which the primary and secondary winding being insulatingly enveloped with a cast material is arranged, the end regions of said main core being connected with each other via a magnetic path located outside said two windings, and having mounting members attached to said magnetic core for mounting said ignition coil to an autmobile body.

From the DE-Cl- No. 25 14 107, it has become known to embed bar core ignition coils for internal combustion engines, which consist of an open magnetic circuit with a ferromagnetic core and a ferromagnetic sleeve, in insulating hardened synthetic material. In order to effect the necessary conduction of heat from the ignition coil, on the outer side of the block of synthetic material the ferromagnetic sleeve, consisting for example of two half shelves, is arranged, and mounted to the surface of the block of synthetic material by means of a collar bracket, which in turn permits a holding of the inition coil on the body of a vehicle.

An ignition coil of the initially described type having a magnetic core of the core type and mounting members attached to the magnetic core has become known from the EP-Al- No. 0 043 744 and an ignition coil of the initially described type with magnetic core of the sleeve type and with primary and secondary winding being insulatingly enveloped with a cast material has become known from the DE-Al- No. 31 44 528. The so-called closed magnetic circuits of such ignition coils consist of laminated sheets of the form EI, UI, EE, UU, etc. and, contrary to bar core ignition coils, permit the assembly of ignition coils of large magnetic coupling between primary and secondary winding and thus a reduction of the main dimensions, based on an equally large energy storing ability. The primary winding on the primary coil body and the secondary coil body provided with the secondary winding together with the high voltage terminal with the terminal fitting and the primary terminal points are introduced for example after electric contacting into a mold and insulatingly enveloped therein by means of a cast material.

In the known constructions for holding the ignition coil and for the mounting of the ignition coil to the sheet metal of the automobile body, the dissipated heat occurring in the ignition coil is mainly dissipated by convection and radiation, because the conduction of heat from the coils to the core and via the mounting members to the large area sheet metal of the automobile body is insufficient due to the series connection of a plurality of heat resistances. From the cooler surface of the cast resin ignition coil radially towards the main core, there is such a large drop in temperature that the winding adjacent to the main core can even be overburdened in the event of constantly dimensioned specific material stress (current density).

The invention is based on the object of bringing with given dissipated heat and volume of construction and approximately equal current density the heating of the windings of an ignition coil of the type described above to approximately the same level and furthermore to reduce the heatings of the windings, namely by optimizing the conduction of heat to the sheet metal of the automobile body.

In an ignition coil of the type described above this object is solved according to the invention in that the mounting members are formed of a mounting plate with mounting surface and of at least one frame member integrally formed with the mounting plate, and that the frame members envelope the parts of the magnet core forming said magnetic path outside the windings in a form-locking manner abutting in direct contact on three sides of said parts.

Expediently the frame members consist of U-shaped holders, in which the members of the magnetic core lying outside the windings are received on three sides in form-locking abutment.

Advantageously the frame members are formed as holders being L-shaped in longitudinal section and the magnetic core is held in laminar direction pressed between the L-shaped holders.

Expediently the frame members of the core packet form of the magnetic core can be formed accordingly in plan view in U- or E-form.

The mounting plates can be advantageously formed with mounting surfaces extending unilaterally or symmetrically to the axis of the main core.

According to an expedient embodiment of the ignition coil, a mounting plate with mounting surface parallel to the axis of said main core is arranged on one of the frame members, said frame member engagingly receiving the magnetic core in mounting direction to the mounting plate in U-shaped recesses up to approx. centrally to the main core axis or extending over the entire core width, whereas the other frame member having U-shaped recesses receives the remaining magnetic core and the two frame members are abutting or pushed against each other in overlapping relationship.

In a preferred embodiment of the ignition coil according to the invention, at least one of the frame members is formed as L-shaped connection piece adjacent to the mounting plate. Perpendicular to the laminar direction of the magnetic core, the L-bar of the L-shaped connection piece is equally large or somewhat smaller than half the height of the core layer.

An especially advantageous development of the ignition coil according to the invention consists in that for mounting the frame member or members at the surfaces of the ignition coil bearing primary and secondary terminals are placeable firstly angular to the surface of the magnetic core, and then are pivotable in abutment with the total surface of the magnetic core.

Expediently the cast material body of the ignition coil has recesses on the side of the primary and secondary terminals for receiving the parts of the frame members coming to rest there, especially the L-bars.

The cast material body of the ignition coil advantageously has roof-like inclined surface on the side lying opposite the primary and secondary terminals in the range of pivot of the frame members, whereby the frame members envelopping the magnetic core can respectively cover approximately half the height of the core layer.

In order to increase both the mechanical strength and to enlarge the heat conduction value, additional stiffening ribs can be provided between mounting plate and frame member.

The width of the cast material body of the ignition coil is expediently slightly smaller than the inner width of the frame members.

Especially in the event of a greater layer height of the magnetic core, advantageously in the magnetic core approximately centrally to the layer height, one or more aluminium core sheets can be inserted which are bent at right angles on the side facing the mounting plate and are in frictional connection with the frame members.

In order to improve the heat contact between the cast material body containing the coils with the magnetic core, and additionally to fix the cast material body to the main core, between the main core and the cast material body of the ignition coil a strikable hardenable cast resin paste can be applied which is compatible with the cast resin of the cast material body.

Mounting plate and frame members expediently consist of a material having a good conduction of heat such as corrosion resistant aluminium alloy, advantageously of an aluminium die cast alloy, which is especially resistant to sea water.

Mounting holes in the mounting plate are expediently sunk. In connection with the aluminium die cast alloy this especially has the advantage that bolts can be welded to the automobile body.

Furthermore, the ignition coil according to the invention advantageously comprises a cover on the side of the primay and secondary terminals which is of polygonal construction for the purpose of a more stable holding to the ignition coil, and on the frame members supporting surface members for the inner surfaces of the polygonal cover are mounted.

A further development of the invention is finally to be seen in that the shaping of the frame members of good heat conduction and the mounting plates is designed for optimal heat conduction to be form and frictionally locked on the automobile body in combination with an associated ignition switching device.

The invention is described in more detail in the following on the basis of embodiments and drawings. The drawings show FIG. 1 a first embodiment of the cast resin ignition coil optimized according to the invention in side view, FIG. 2 the ignition coil according to FIG. 1 in plan view, FIG. 3 a second embodiment of the cast resin ignition coil optimized according to the invention in side view, FIG. 4 the ignition coil according to FIG. 3 in plan view, FIG. 5 a third embodiment of the cast resin ignition coil optimized according to the invention in side view, partially intersected, FIG. 6 the ignition coil according to FIG. 5 in plan view, FIG. 7 a fourth embodiment of the cast resin ignition coil optimized according to the invention in side view, partially intersected, FIG. 8 the ignition coil according to FIG. 7 in plan view, also partially intersected, FIG. 9 the detail A in FIG. 8 in enlarged representation, FIG. 10 a fifth embodiment of the cast resin ignition coil optimized according to the invention in side view, partially intersected, FIG. 11 the ignition coil according to FIG. 10 in plan view, also partially intersected, and FIG. 12 the representation of over temperatures on two ignition coils dependent on the power loss in double logarithmic scale.

Figure 2:
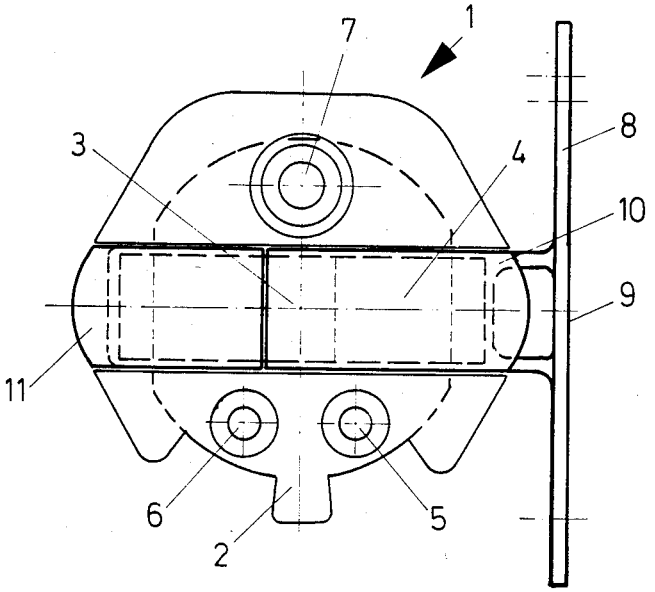

In FIGS. 1 and 2, a first embodiment of an ignition coil 1 with optimization of heat conduction to the sheet metal of the automobile body according to the invention is shown. Primary and secondary winding are insulatingly enveloped with cast material into a cast material body 2. The cast material body 2 envelopes the main core 3 of the magnetic core 4. On the upper side of the cast material body 2, primary terminals 5 and 6 and a secondary terminal 7 are arranged and advantageously cast into said cast material body. Mounting members for the ignition coil 1 consist of at least one mounting plate 8 with mounting surface 9 and a frame member 10 integrally formed therewith and a further frame member 11. The frame members envelope the parts of the magnetic core 4 forming the magnetic path outside the two windings in a form-locking manner consisting of U-shaped holders, in which the magnetic core is received in a form-locking manner abutting on three sides. The mounting plate 8 is mounted on the frame member 10 in such a manner, that the mounting surface 9 extends parallel to the axis of the main core 3.

Figure 3:
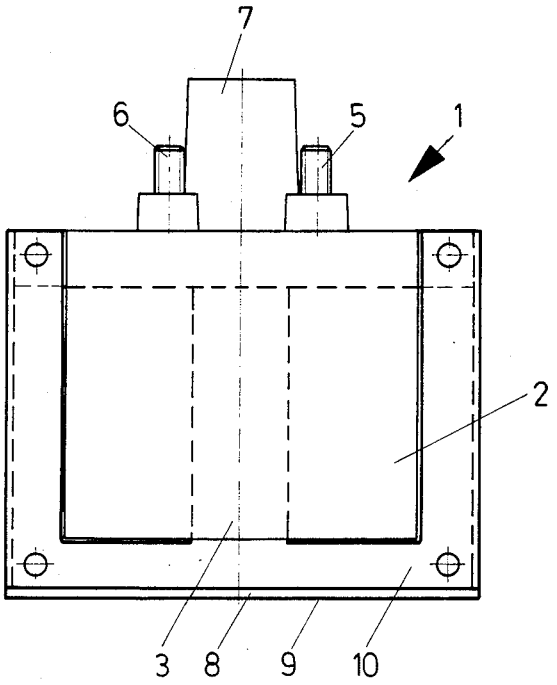
Figure 4:
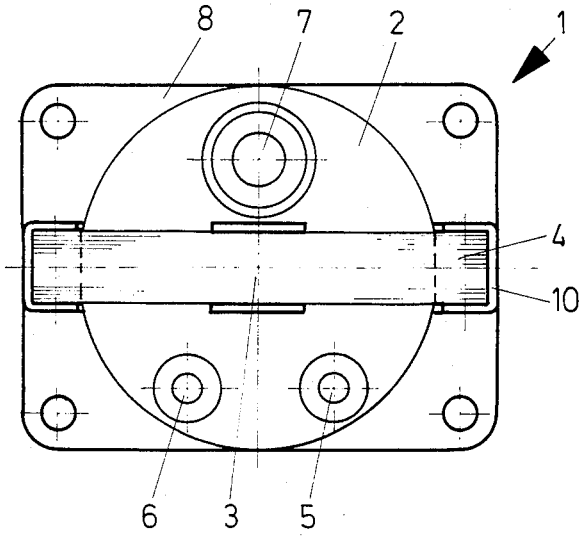

In FIGS. 3 and 4, a second embodiment of the ignition coil optimized according to the invention. Here the mounting plate 8 is mounted on the frame member 10 in such a manner, that the mounting surface 9 extends perpendicular to the axis of the main core 3. Furthermore, the frame member 10 also covers the side surfaces of the main core 3.

Figure 5:
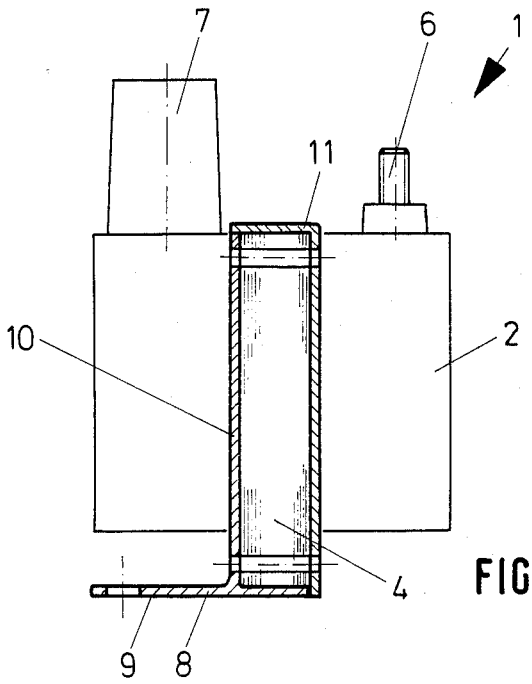
Figure 6:
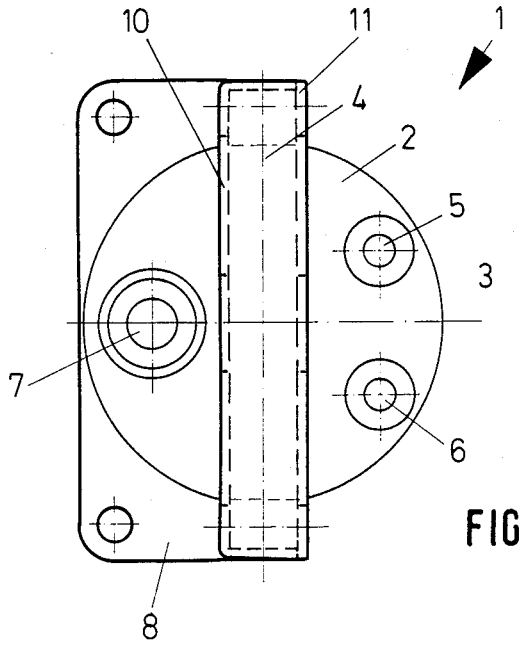

In FIGS. 5 and 6, a third embodiment of the ignition coil optimized according to the invention is represented, wherein the mounting plate 8 with the mounting surface 9 is mounted perpendicular to the axis of the main core 3 on the frame member 10 and is formed unilaterally to the axis of the main core 3. The frame members 10 and 11 are formed as holders L-shaped in longitudinal section and the magnetic core 4 is held in laminar direction pressed between these L-shaped holders.

Figure 7:
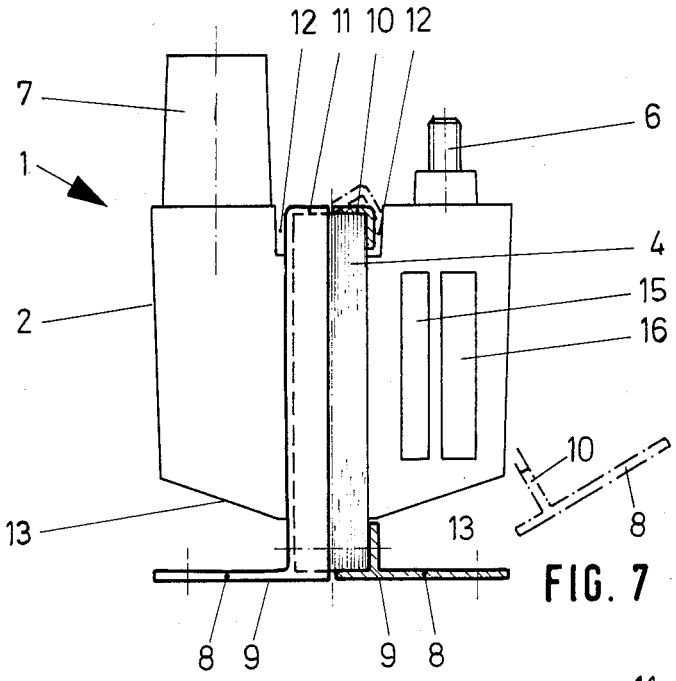
Figure 9:
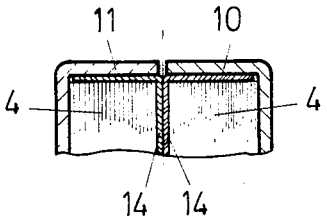
Figure 8:
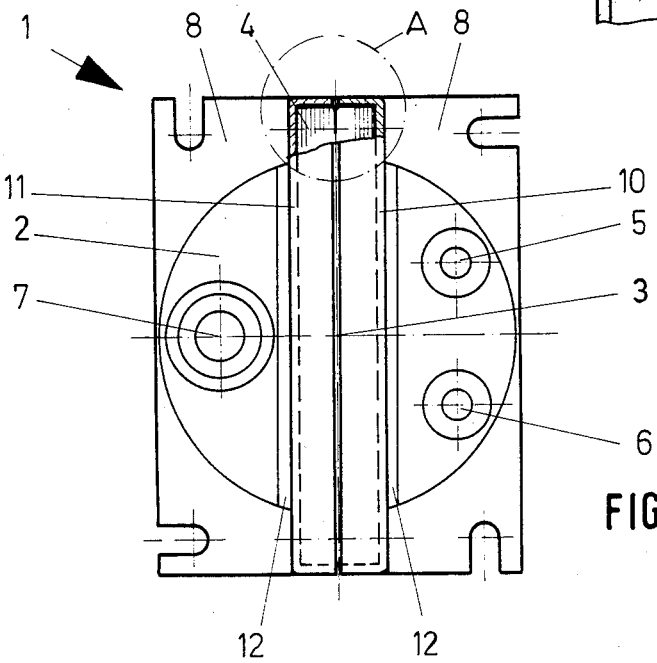

The FIGS. 7 to 9 show a fourth embodiment of the ignition coil optimized according to the invention. Here respectively one half of the mounting plate 8 with the mounting surface 9 is mounted perpendicular to the axis of the main core 3 on the frame member 10 and the frame member 11 in such a manner that the mounting plate 8 with the mounting surface 9 is formed as a whole symmetrically to the axis of the main core 3. Perpendicular to the laminar direction of the magnetic core 4, L-bars of the frame members 10 and 11 formed as L-shaped connection pieces are equally large or somewhat smaller than half the height of the core layer. It is achieved herewith that the frame members 10 and 11 with their parts of the mounting plate 8 are equal in construction and accordingly only two such members are necessary for an ignition coil.

The frame members 10 and 11 for the mounting on the surface of the ignition coil 1 bearing the primary and secondary terminals 5, 6 and 7 are placeably firstly angular to the surface of the magnetic core and then are pivotable in the direction of the arrow in FIG. 7 in abutment with the total surface of the magnetic core 4. In the cast material body 2 on the side of the primary and secondary terminals 5, 6, 7 recesses are provided to receive the frame members 10, 11 coming to rest there. On the side of the ignition coil 1 lying opposite the primary and secondary terminals 5, 6, 7 the cast material body 2 has roof-like inclined surfaces 13 in the range of pivot of the frame members 10, 11.

In the magnetic core 4 two aluminium core sheets 14 are introduced approximately centrally to the layer height which are bent at right angles and are in frictional connection with the frame members 10, 11. The primary winding is designated with 15, the secondary winding with 16.

Figure 10:
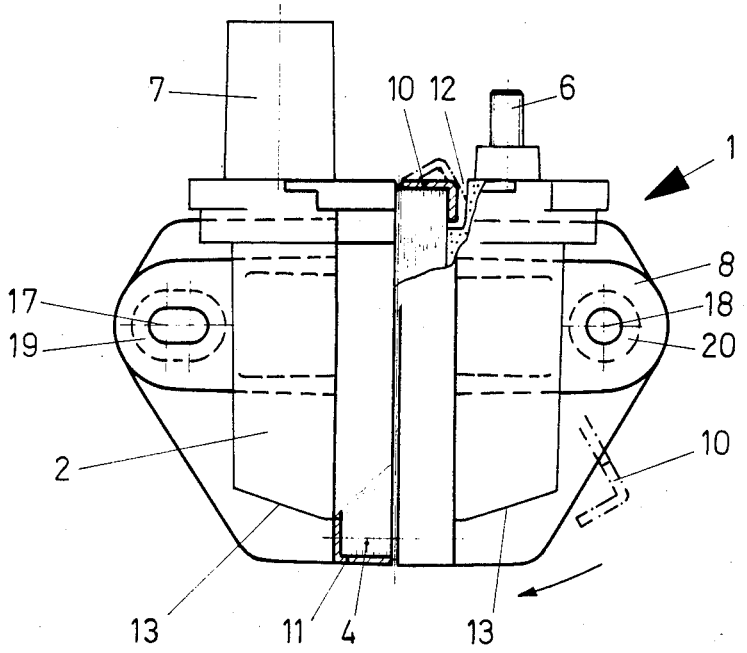
Figure 11:
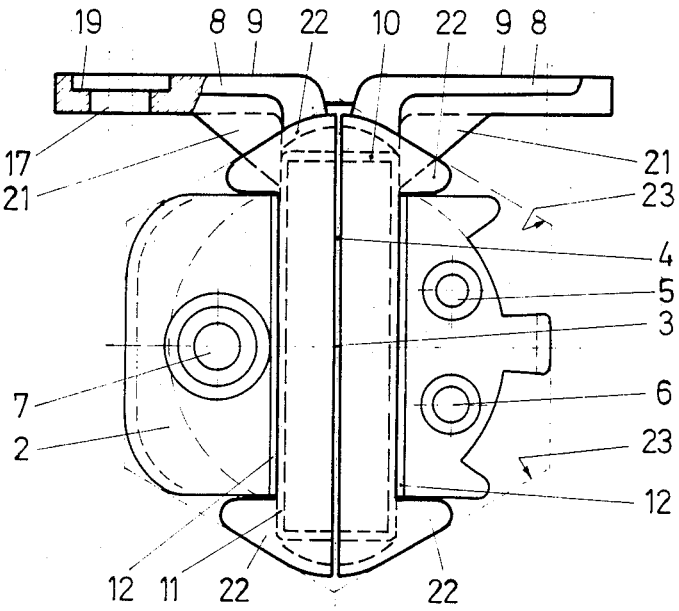

In FIGS. 10 and 11, a fifth embodiment of the ignition coil optimized according to the invention is represented similar to the fourth embodiment. Herein the two parts of the mounting plate 8 with the mounting surface 9 are mounted parallel to axis of the main core 3. The mounting plate 8 has mounting holes 17, 18 with depressions 19, 20 on the side of the mounting surface 9. Between the mounting plate 8 and the frame members 10, 11, additional stiffening ribs 21 are provided which effect an additional improvement of the conduction of heat.

On the frame members 10, 11, further supporting surface members 22 are mounted, which can support and hold the inner surfaces 23 of a polygonal cover.

Between the main core 3 and the cast material body 2 of the ignition coil 1, preferably a strikable hardenable cast resin paste can be applied. The mounting plate 8 and the frame members 10, 11 preferably consist of a material of good conduction such as a corrosion resistant aluminium alloy, especially an aluminium die cast alloy.

In the described cast resin ignition coils 1, the dissipated heat from the ignition coil is transmitted as a result of the form and frictional locking of the magnetic core 4 without any interruption of the conduction of heat directly to the large area metal sheet automobile body, on which the ignition coil 1 is mounted. In the course of the heat conduction there is no sudden drop in temperature, so that the temperature at this mounting surface 9 is raised as compared to embodiments of the ignition coil known until now and thus, the cooling of the cast resin ignition coil 1 is supported in addition to the cooling by convection and radiation effectively as a result of the heat conduction.

To clarify the effectiveness of the figuration according to the invention of the mounting plate 8 and frame members 10, 11, comparative measurements of over temperatures were made dependent on the power loss on a known cast resin ignition coil with a magnetic core of the sleeve-type and conventional cover construction with flanged mounting angle and on an ignition coil 1 constructed according to FIGS. 10 and 11. Cover and mounting surface of the conventional cast resin ignition coil were produced of steel for reasons of mechanical strength, the frame members 10, 11 and mounting plate 8 of the cast resin ignition coil 1 were produced of aluminium die cast. In both cases the cast resin ignition coils were mounted on a steel sheet with a thickness of 1 mm and a surface of approximately 0,5 $m^2$ as effectively cooling surface of an automobile body sheet.

Figure 12:
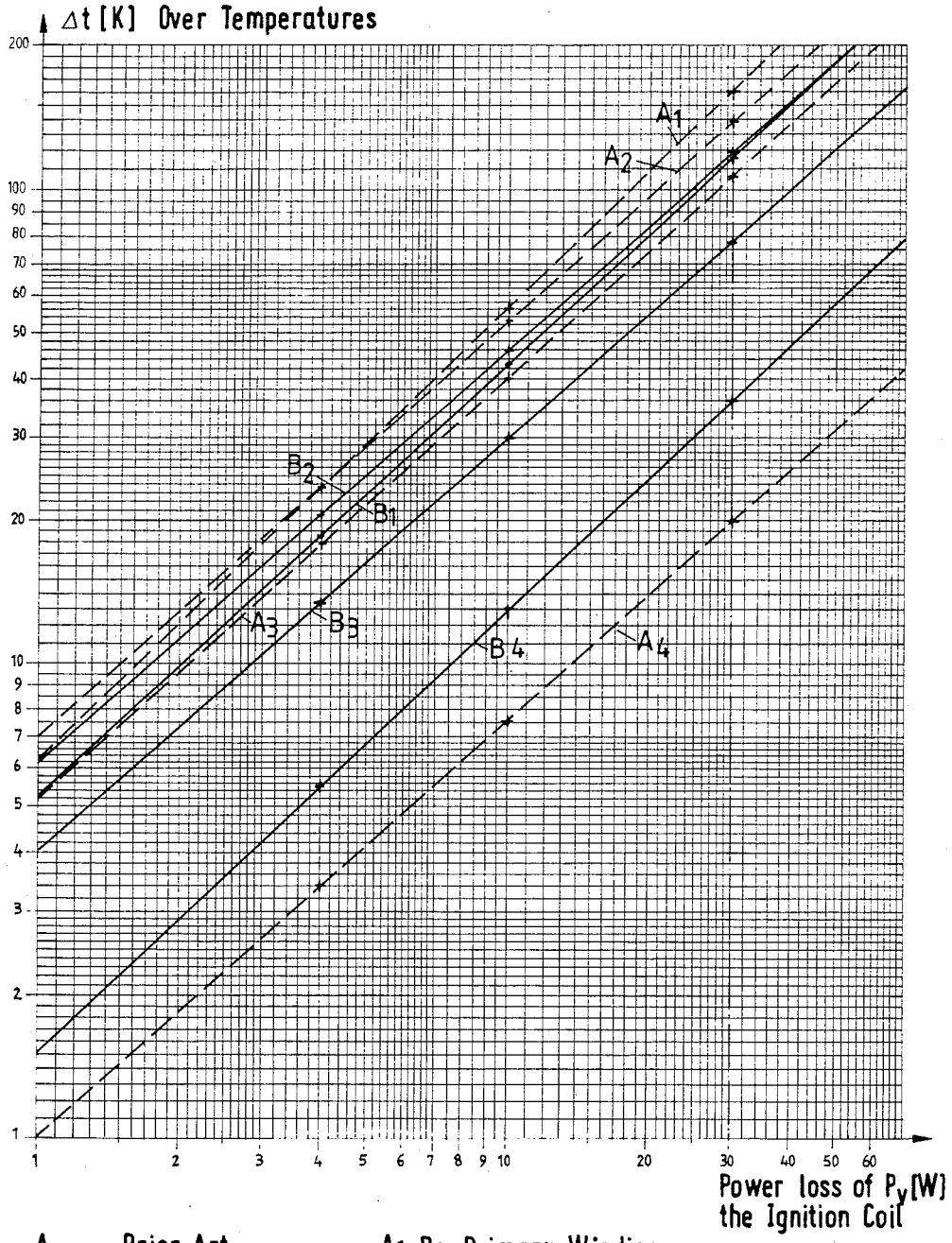

The measured values were applied in double logarithmic scale over the power loss $P_v$ of the cast resin ignition coils in the diagram according to FIG. 12. The curves A represent the measurement curves of the known cast resin ignition coil, the curves B the measurement curves of the cast resin ignition coil 1.

In detail, the curves B1 and A1 represent the over temperatures in the inner primary winding, the curves B2 and A2 in the outer secondary winding, the curves B3 and A3 the over temperature of the surface of the cast material body 2 at the winding close to the core and the curves B4 and A4 the over temperatures at the mounting surface 9.

The curves B1 and B2 clearly show the reduction of the winding temperature in the cast resin ignition coil 1 according to the invention.

A comparison of curves B4 and A4 clearly shows that the temperature at the mounting surface 9 considerably increases, an indication of the good heat conduction of the dissipated heat from the inside of the winding to the mounting surface 9 in the cast resin ignition coil 1 according to the invention.

However, a comparison of curves B1 and B2 shows that the winding lying at the main core 3, which until now due to the drop in temperature from the inside to the outside with same current density was heated considerably more strongly than the outer winding, has assumed approximately the same temperature level as the outer winding. This is due to the fact that now the waste heat occuring in the inside of the cast material body 2 is dissipated on account of the good heat conduction directly over the mounting surface 9 of the ignition coil 1 into the large area metal sheet of the automobile body.

The curves B1 and B2 further show that in the cast resin ignition coil 1 formed according to the invention the over temperatures of the primary and secondary windings have approximately the same values, and dependent on the dissipated heat occuring and thus dependent on the speed of the otto entine, increase in approximately the same degree.

The curves A1 and A2 show that the over temperature of the primary winding lying inside on the core increases more strongly with increasing losses than the secondary winding lying outside in the cast material body, because the conventional ignition coil is mainly cooled by convection and thus the drop in temperature from the inside to the outside increases.

In particular the curves B1 and B2 in comparision with the curves A1 and A2 especially show the effectiveness of the configuration of the cast resin ignition coil 1 according to the invention. With a power loss of the cast resin ignition coil of approximately 30 Watts—this corresponds to approximately 6000 revolutions per minute of an 8-cylinder engine—the winding heating is reduced up to approximately 40K in comparison with the conventional construcion. This means on the one hand that with the use of same insulating materials, the cast resin ignition coil 1 according to the invention can be loaded correspondingly higher, or that the volume of construction can be reduced saving high value materials. On the other hand with the same volume of construction, and thus given constant use temperature, it can be turned to simpler and cheaper insulating materials for the choice of insulating materials.

The achieved effect of good heat conduction has also the advantage that the cast resin ignition coil 1 according to the invention cannot only be applied under normal climatic conditions, but can also be operated in regions with extremely high ambient temperature. An essential advantage of the invention is also to be seen in that for modern electronicly regulated systems, the ignition coils can be loaded with substantially larger primary currents or primary powers and it is further possible to achieve larger ignition powers, or with the same energy absorption of the magnetic circuit to achieve more rapid charging times.

We claim:

1. An ignition coil for internal combustion engines comprising a magnetic core including a main core member having primary and secondary windings thereon and additional magnetic core members connecting the ends of said main core with each other to define a magnetic path located outside said windings, an insulating casting surrounding said windings and a pair of substantially identical mounting members attached to said magnetic core for mounting said ignition coil to an automobile body, each of said mounting members being formed of a mounting plate having a substantial mounting surface perpendicular to the axis of said main core and an L-shaped frame member integrally formed with said mounting plate and extending completely about said casting in engagement with a portion of the periphery of said core and one side thereof whereby upon attachment of said pair of mounting members to said core the portion of said core outside of said casting will be substantially enclosed by said frame members.

2. An ignition coil as set forth in claim 1 further comprising a plurality of terminals extending outwardly of said casting on the sides thereof remote from said mounting plates and wherein said casting is spaced from said core adjacent said terminals to define a pair of grooves on opposite sides of said core for the reception of said frame members and wherein said casting is provided with inclined surfaces adjacent said mounting plate to facilitate placing of said mounting members on said core.

3. An ignition coil according to claim 1 further comprising at least one aluminum core sheet disposed within the magnetic core adjacent the central portion thereof with a portion of each sheet extending outwardly of the core and bent at right angles for frictional engagement between said core and said frame members.

4. An ignition coil according to claim 1 wherein a strikeable, hardenable cast resin paste is applied between said magnetic core and said casting.

5. An ignition coil according to claim 1 wherein said mounting plate and said frame members consist of a corrosion resistant aluminum alloy having good heat conduction.

6. An ignition coil according to claim 1 wherein said mounting plate and said frame members consist of an aluminum die-cast alloy.

7. An ignition coil according to claim 1 wherein said frame members and associated ignition coil are provided with form and frictional locking means to provide optimal heat conduction to said mounting plates which have a configuration complementary to an automobile body surface upon which the ignition coil is adapted to be mounted.

* * * * *